US010035628B2

(12) United States Patent
Akaogi et al.

(10) Patent No.: US 10,035,628 B2
(45) Date of Patent: Jul. 31, 2018

(54) SPOUT, PACKAGE WITH SPOUT AND METHOD OF MANUFACTURING THE SAME

(71) Applicant: ORIHIRO ENGINEERING CO., LTD., Tomioka-shi (JP)

(72) Inventors: Takahiro Akaogi, Hiratsuka (JP); Masataka Tsuruta, Tomioka (JP)

(73) Assignee: Orihiro Engineering Co., Ltd., Tomioka-shi, Gunma (JP)

( * ) Notice: Subject to any disclaimer, the term of this patent is extended or adjusted under 35 U.S.C. 154(b) by 250 days.

(21) Appl. No.: 14/441,986

(22) PCT Filed: Sep. 13, 2013

(86) PCT No.: PCT/JP2013/074815
§ 371 (c)(1),
(2) Date: May 11, 2015

(87) PCT Pub. No.: WO2014/073269
PCT Pub. Date: May 15, 2014

(65) Prior Publication Data

US 2015/0321803 A1 Nov. 12, 2015

(30) Foreign Application Priority Data

Nov. 9, 2012 (JP) ..... 2012-247320

(51) Int. Cl.
*B65D 47/10* (2006.01)
*B65D 33/16* (2006.01)
(Continued)

(52) U.S. Cl.
CPC ..... *B65D 47/10* (2013.01); *B65D 33/16* (2013.01); *B65D 41/0471* (2013.01);
(Continued)

(58) Field of Classification Search
CPC .... B65D 2251/0071; B65D 2251/0015; B65D 2251/0025; B65D 51/228; B65D 47/10;
(Continued)

(56) References Cited

U.S. PATENT DOCUMENTS 3,910,463 A * 10/1975 Reese ..... B65D 50/046 215/216
4,408,700 A * 10/1983 Fillmore ..... B65D 47/247 222/153.06
(Continued)

FOREIGN PATENT DOCUMENTS

JP 2006-062752 A 3/2006
JP 2008-30759 A 2/2008
(Continued)

*Primary Examiner* — Charles P Cheyney
(74) *Attorney, Agent, or Firm* — Knobbe, Martens, Olson & Bear, LLP

(57) ABSTRACT

Breakable spout (100) of the present invention individually comprises spout body (110) and cover (160) that covers an outer circumference of spout body (110). Spout body (110) comprises cylindrical part (120) that has a center hole that serves as a flow channel (111) and breakable part (150) that is breakable at the tip end of cylindrical part (120). Cylindrical part (120) has a first protrusion (123) on an outer circumferential surface thereof. The cover has second protrusion (161) on an inner circumferential surface thereof. Second protrusion (161) engages first protrusion (123) when cover (160) is fitted to spout body (110) such that spout body (110) is covered with cover (120) from the tip end side of cylindrical part (120). Cover (160) covers spout body (110) and is secured when the first protrusion (123) engages the second protrusion (161). Opening (169) is formed in the portion of cover (160) that corresponds to communication hole (155) of annular part (154) when cover (160) is fitted to the spout body and covers spout body (110).

10 Claims, 8 Drawing Sheets

(51) Int. Cl.
*B65D 75/58* (2006.01)
*B65D 41/04* (2006.01)

(52) U.S. Cl.
CPC .. *B65D 75/5883* (2013.01); *B65D 2251/0015* (2013.01); *B65D 2251/0071* (2013.01)

(58) Field of Classification Search
CPC . B65D 75/5883; B65D 41/0471; B65D 33/16
USPC ..... 222/541.8, 153.06, 541.5, 107, 105, 222/541.4, 541.1; 215/48
See application file for complete search history.

(56) References Cited

U.S. PATENT DOCUMENTS 4,620,638 A * 11/1986 Schmidt ..... A61J 9/00 215/11.1
5,228,593 A * 7/1993 O'Meara ..... B65D 35/22 215/253
5,297,697 A * 3/1994 Boring ..... B05C 17/00516 137/68.23
5,425,920 A * 6/1995 Conti ..... A61J 1/06 422/537
6,443,330 B1 * 9/2002 Kuboshima ..... B65D 1/0238 222/153.06
7,188,750 B2 * 3/2007 Vogel ..... A61J 1/18 215/48
7,762,414 B2 * 7/2010 Uytterhaeghe ..... B65D 47/10 215/253
7,905,873 B2 * 3/2011 Rondeau ..... A61M 39/26 251/142
8,397,927 B2 * 3/2013 Krebs ..... B65D 51/228 215/308
8,434,651 B2 * 5/2013 Miyazaki ..... B65D 41/0471 215/216

FOREIGN PATENT DOCUMENTS

JP 2009-046184 A 3/2008
JP 2010-18319 A 1/2010

* cited by examiner

SPOUT, PACKAGE WITH SPOUT AND METHOD OF MANUFACTURING THE SAME

CROSS-REFERENCE TO RELATED APPLICATIONS

This application is the U.S. National Phase under 35. U.S.C. § 371 of International Application PCT/JP2013/074815, filed Sep. 13, 2013, which claims priority to Japanese Patent Application No. 2012-247320, filed Nov. 9, 2012. The disclosures of the above-described applications are hereby incorporated by reference in their entirety.

TECHNICAL FIELD

The present invention relates to a spout used by being welded to a package that holds content, such as a beverage. The present invention relates, in particular, to a spout having a center hole that is formed into a flow channel in the form of a through hole by breaking off a member that is integrally formed at the tip end of the spout. In the description, such a spout is referred to as a breakable spout. The present invention further relates to a bag-shaped package that includes the breakable spout and a method of manufacturing the bag-shaped package.

BACKGROUND ART

Such a breakable spout has hitherto been known. A breakable spout having a cover is also known from Patent Literature 1: JP2006-62752 and Patent Literature 2: JP2009-46184.

Specifically, the outer circumferential surface of a spout body on the tip end side is covered with a cover in order to prevent a human hand from coming into direct contact with the spout body from the standpoint of ensuring hygiene. The breakable part can be separated by removing the cover so that user convenience is improved.

However, the breakable spouts disclosed in Patent Literatures 1 and 2 are configured such that the cover (caps 12 and 3) is secured by being fitted into the breakable part (threading protrusion 18 and sealing member 15). Thus, force may be generated when the cover (caps 12 and 3) is fitted into the breakable part (threading protrusion 18 and sealing member 15) and the force may damage a weakened part (thin parts 24 and 16) and cause sealing performance to deteriorate.

Further, when external force is applied to the cover (caps 12 and 3) during transportation or storage, the force that is applied to the breakable part (thread cutting protrusion 18 and sealing member 15) may damage the weakened part (thin parts 24 and 16) and deteriorate sealing performance.

When the conventional breakable spout described above is manufactured, one of the openings at one of the two ends of the cylindrical spout is closed by the breakable part (threading protrusion 18 and sealing member 15). Therefore, since the hole of the manufactured spout has a dead end having a bottom, chemical agents tend to be left in the spout when the spout is washed. Moreover, when a pouch, to which the spout is fitted, is charged with a liquid content, the content may not be able to enter the spout.

PRIOR ART

Patent Literature

Patent Literature 1: JP2006-62752
Patent Literature 2: JP2009-46184

SUMMARY OF INVENTION

The present invention provides a solution to the aforementioned problems of the conventional breakable spout. The objects of the invention are, for example, to facilitate the manufacturing and assembling processes, to improve user convenience and to prevent the loss of sealing performance due to damage to the weakened part during assembly, transportation or storage. Another object is to facilitate washing processes and to charge the spout with a sufficient quantity of content.

According to an embodiment of the present invention, a breakable spout is provided that comprises a spout body and a cover that covers an outer circumference of the spout body. The spout body comprises a cylindrical part that has a center hole that serves as a flow channel and a breakable part that is breakable at the tip end. The breakable part is integrally formed at a tip end of the cylindrical part such that one end of the flow channel is closed, and the breakable part is breakable at the tip end such that the one end of the flow channel is open. The spout body and the cover are individually manufactured and assembled into the breakable spout.

The spout body comprises a deformable annular part. The deformable annular part is formed such that a side wall of the annular part protrudes from the breakable part toward a side opposite to the cylindrical part. A center hole of the annular part is a communication hole that communicates with the flow channel through the breakable part. The communication hole is a hole that is closed by deforming the annular part.

The cover is configured to cover the spout body, including the annular part, from a tip end side of the cylindrical part.

Further, the cylindrical part has a first protrusion on an outer circumferential surface thereof. The cover has a second protrusion on an inner circumferential surface thereof, wherein the second protrusion engages the first protrusion when the cover is fitted to the spout body such that the spout body, including the annular part, is covered with the cover from the tip end side of the cylindrical part. The cover covers the spout body and is secured when the first protrusion engages the second protrusion.

The cover is shaped such that the inner surface of the cover does not contact the breakable part when the cover is fitted to the spout body and covers the spout body. An opening is formed in the portion of the cover that corresponds to the communication hole of the annular part when the cover is fitted to the spout body and covers the spout body.

According to another embodiment of the present invention, a bag-shaped package is provided having a spout that comprises a bag-shaped package to house content and a breakable spout that serves as a spout of the bag-shaped package according to the aforementioned embodiment.

According to yet another embodiment of the present invention, a method of manufacturing the bag shaped package according to another aforementioned embodiment, that has the spout, is provided. The method comprises washing the flow channel of the breakable spout and thereafter closing the communication hole.

According to the breakable spout of the aforementioned embodiment, the cover is placed over the spout body and is secured when the second protrusion on the inner circumferential surface of the cover engages the second protrusion on the outer circumferential surface of the spout body. Therefore, force is not applied to the breakable part or to the weakened part that allows the breakable part to be broken off from the tip end of the cylindrical part. Damage to the weakened part can be prevented, and sealing performance is not lost.

When the cover is fitted to the spout body and covers the spout body, the inside surface of the cover does not contact the breakable par. Thus, direct force will not be applied to the breakable part or to the weakened part from the outside. Moreover, since the cover covers the spout body, including the annular part, direct force will not be applied to the annular part from the outside although the annular part projects from the tip end of the cylindrical part. Therefore, during the transportation or storage processes, damage to the weakened part due to unintended external force can be prevented.

Further, the annular part is disposed at the tip end of the cylindrical part of the spout body. The center hole of the annular part is a communication hole that communicates with the flow channel of the cylindrical part through the breakable part, and the communication hole can be closed after the flow channel is washed. Therefore, the inside of the spout can be easily washed. Moreover, the spout can be charged with content without leaving any space in the spout because the communication hole is closed after the bag-shaped package is charged with content.

According to another embodiment of the bag-shaped package having the spout, the inside of the spout can be washed after the package is manufactured. Therefore, germs or foreign objects will not remain inside the spout and a hygienic bag-shaped package having the spout can be achieved.

Further, because the cover has an opening and the spout body has a communication hole, the package can be charged with content via the spout. Therefore, for the purpose of charging the bag-shaped package with the content, it is not necessary to have any special configurations or processes and fewer restrictions are placed on the shape and manufacturing processes of the bag-shaped package.

Moreover, by closing the communication hole after the package is charged with content via the spout, the package can be charged without leaving any space in the spout.

REFERENCE NUMERALS

Figure 1:
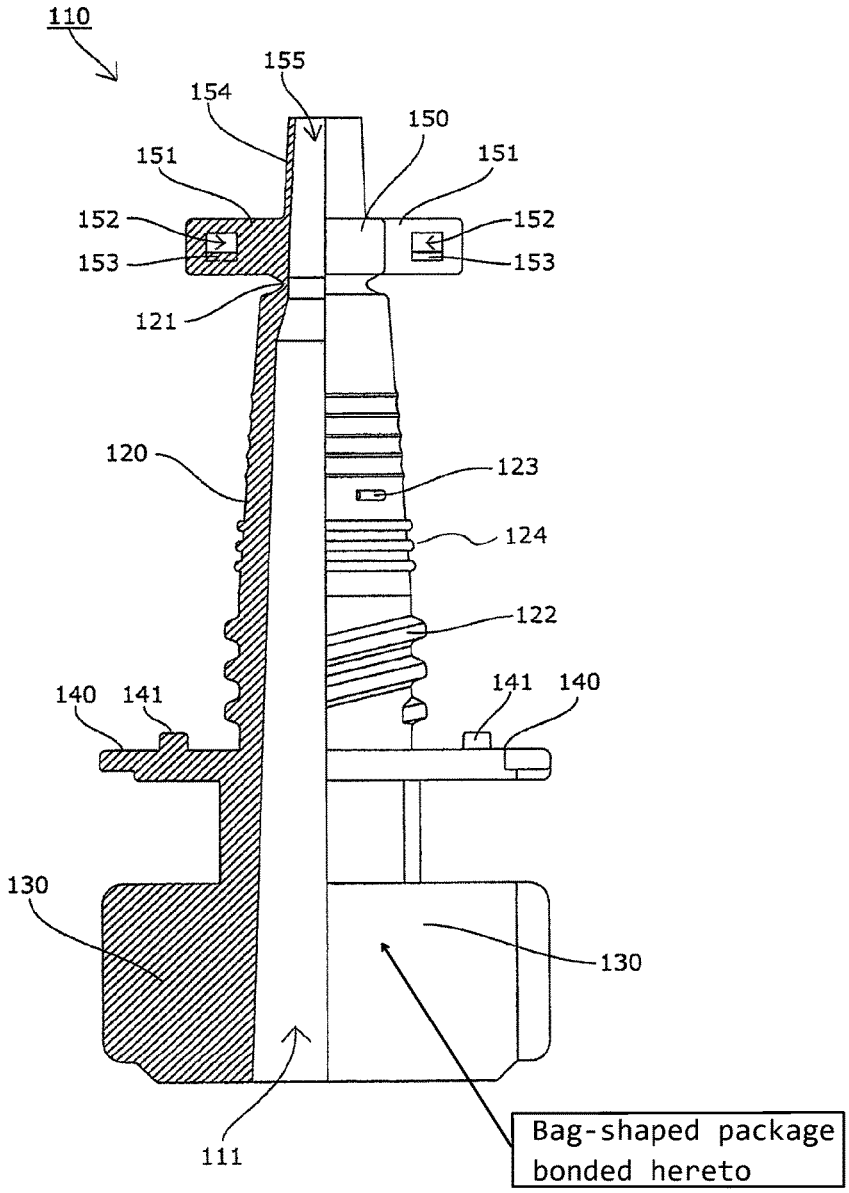
FIG. 1 is a half-sectional front view illustrating the spout body of a breakable spout according to an embodiment of the present invention.

100 Breakable spout
110 Spout body
111 Flow channel
120 Cylindrical part
121 Weakened part
122 Threaded part
123 Protrusion
130 Fitting part
140 Flange part
141 Protrusion
150 Breakable part
151 Operation arm
152 Engaging hole
153 Locking protrusion
154 Annular part
155 Communication hole
160 Cover
161 Protrusion
162 Contacting protrusion part (Rib)
163 Insertion arm
164 Leg part
165 Protrusion
166 Leg part
167 Insertion window
168 Detergent circulation port
169 Opening

DESCRIPTION OF EMBODIMENTS

Hereinafter, the configuration of breakable spout 100 according to an embodiment of the present invention will be described with reference to the drawings.

Referring to FIGS. 1 to 9, breakable spout 100 according to the embodiment includes spout body 110 and cover 160 that covers spout body 110 from the tip end side. Spout body 110 and cover 160 are individually formed by means of a mold. Spout body 110 and cover 160 are formed, for example, by injection molding of resin.

Figure 2:
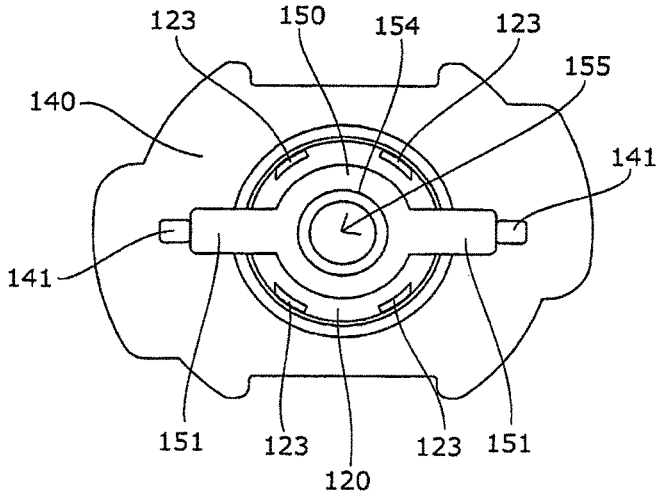
FIG. 2 is a plan view illustrating the spout body of the breakable spout according to the embodiment of the present invention.

As illustrated in FIGS. 1 and 2, spout body 110 is comprised of cylindrical part 120, breakable part 150, fitting part 130 and flange part 140. Breakable part 150 is integrally formed at one end of cylindrical part 120 via weakened part 121. Fitting part 130 is the other end of cylindrical part 120 and fitted to a bag-shaped package, such as a pouch. Flange part 140 protrudes from cylindrical part 120 at a position near fitting part 130. A center hole that penetrates the center of cylindrical part 120 forms flow channel 111.

Annular part 154 protrudes on the tip end side of breakable part 150. Communication hole 155 that communicates with flow channel 111 through breakable part 130 is formed inside of annular part 154. Communication hole 155 is open at the tip end side of annular part 154.

Breakable part 150 includes a pair of operation arms 151 that extend orthogonal to the direction in which annular part 154 protrudes (in which flow channel 111 extends). By twisting operation arms 151, weakened part 121 is broken to separate breakable part 150 from cylindrical part 120 and opens the tip end of flow channel 111.

Figure 6:
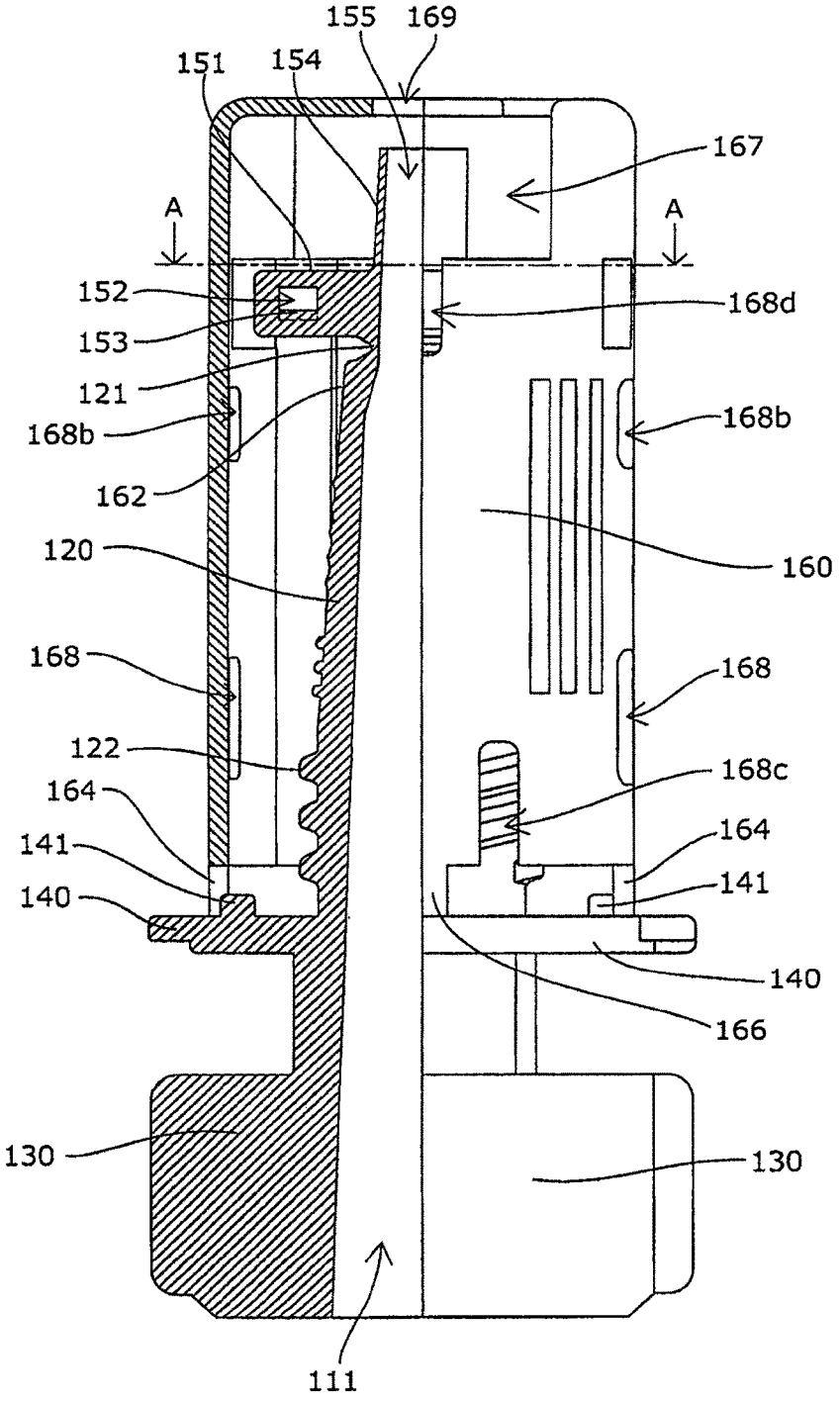
FIG. 6 is a half-sectional front view illustrating the assembled breakable spout according to the embodiment of the present invention.
Figure 7:
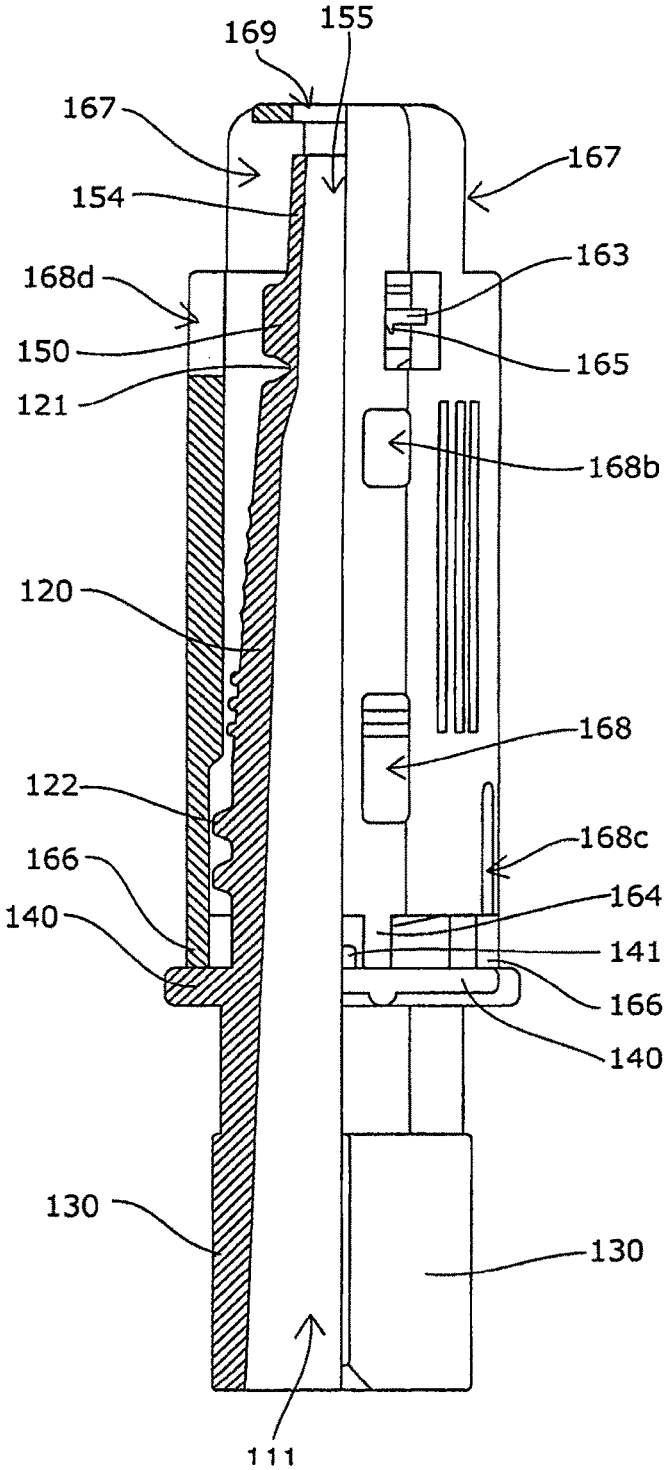
FIG. 7 is a half-sectional side view illustrating the assembled breakable spout according to the embodiment of the present invention.

Operation arms 151 include engaging holes 152 that are open in a direction along a circumference that is concentric with flow channel 111. Of the side surfaces of engaging hole 152, locking protrusion 53 is disposed on the side surface of engaging hole 152 that faces upward, as illustrated in FIGS. 1 and 6. Locking protrusion 153 protrudes upwardly and traverses the side surface in the direction in which operation arm 151 extends.

A plurality of protrusions 123 is disposed below weakened part 121 on the outer circumferential surface of cylindrical part 120. Protrusions 123 engage a plurality of protrusions 161 that is formed on the inner circumferential surface of cover 160, described later. Threaded part 122 that is connected to a piping member, such as a tube, and ring-shaped protrusions 124 are further disposed on the outer circumferential surface of cylindrical part 120. Ring-shaped protrusions 124 keep the tube etc. in close contact with cylindrical part 120 or prevent the tube etc. from being pulled out, depending on the purpose of use.

Protrusions 141 are disposed on the top surface of flange part 140. Protrusions 141 engage leg parts 164 of cover 160, described later.

As illustrated in FIGS. 3 to 8, protrusions 161, ribs 162, that function as contacting protrusion parts, and insertion arms 163 are formed on the inner circumferential surface of cover 160. Leg parts 164 are provided at the lower end surface of cover 160. Further, the inner surface of cover 160 is shaped so as not to contact breakable part 150 when cover 160 is fitted to the tip end side of spout body 110 and covers spout body 110.

Figure 8:
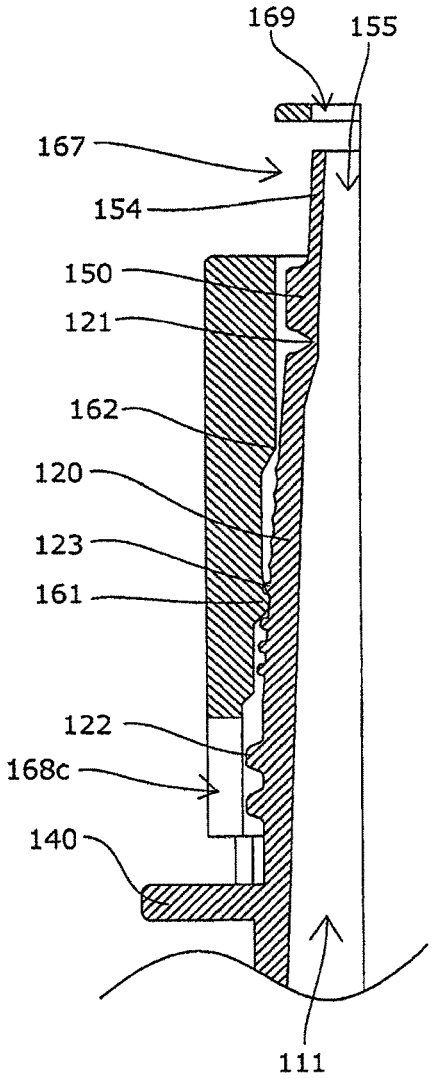
FIG. 8 is a sectional view illustrating the rib part of the assembled breakable spout according to the embodiment of the present invention.

Protrusions 161 on the inner circumferential surface of cover 160 are formed such that they engage protrusions 123 on the outer circumferential surface of cylindrical part 120 and secure cover 160 when cover 160 covers the tip end side of spout body 110 (refer to FIG. 8).

A plurality of ribs 162 that extend vertically above protrusions 161 is provided on the inner circumferential surface of cover 160. The ribs are formed such that they contact or approach the outer circumferential surface of cylindrical part 120 above protrusions 123 when cover 160 is fitted to the tip end side of spout body 110 and covers spout body 110. In this embodiment, protrusions 161 and ribs 162 are formed continuously in the vertical direction at the same circumferential positions on the inner surface of cover 160 (FIG. 3).

Insertion windows 167, through which a member can be inserted, are formed on the two opposing side surfaces of cover 160 on the tip end side, as illustrated in FIGS. 3 to 8. The member is deforming means (not illustrated) that deforms annular part 154 on the spout side in order to close communication hole 155. Opening 169 that corresponds to communication hole 155 is formed at the top of cover 160 on the tip end side.

Cover 160 further includes a plurality of detergent circulation ports below insertion windows 167. In the embodiment, detergent circulation ports 168 are provided below the center of cover 160, and smaller detergent circulation ports 168*b* are provided above circulation ports 168. Further, detergent circulation ports 168*c* are formed by upwardly cutting away a part of cover 160 from the lower end of the cover. Detergent circulation ports 168*d* are also formed by downwardly cutting away cover 160 from a part of the edges of insertion windows 167.

Figure 3:
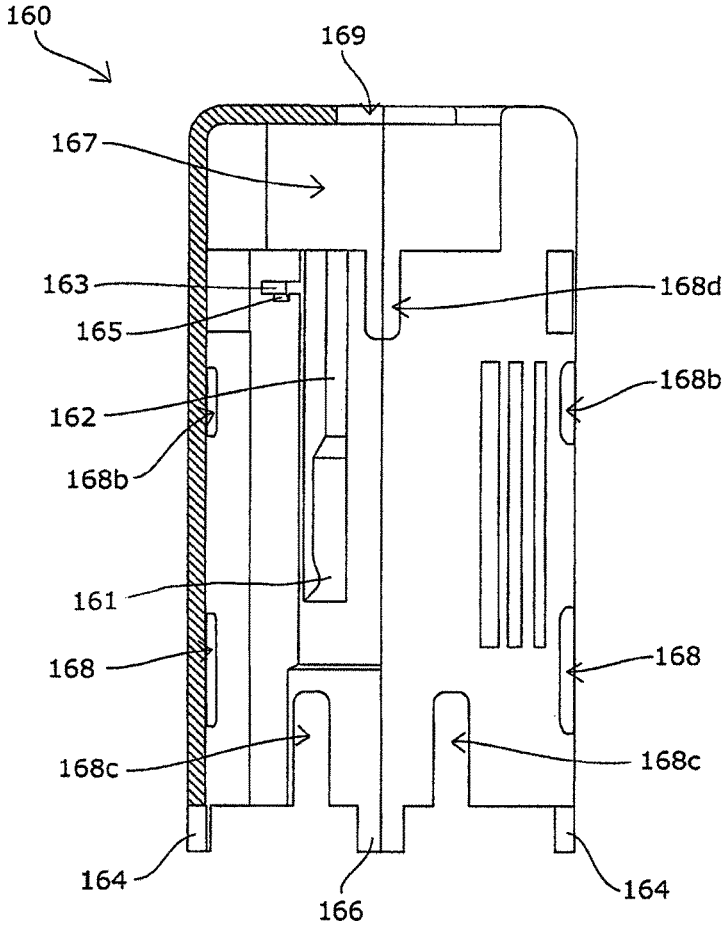
FIG. 3 is a half-sectional front view illustrating the cover member of the breakable spout according to the embodiment of the present invention.
Figure 4:
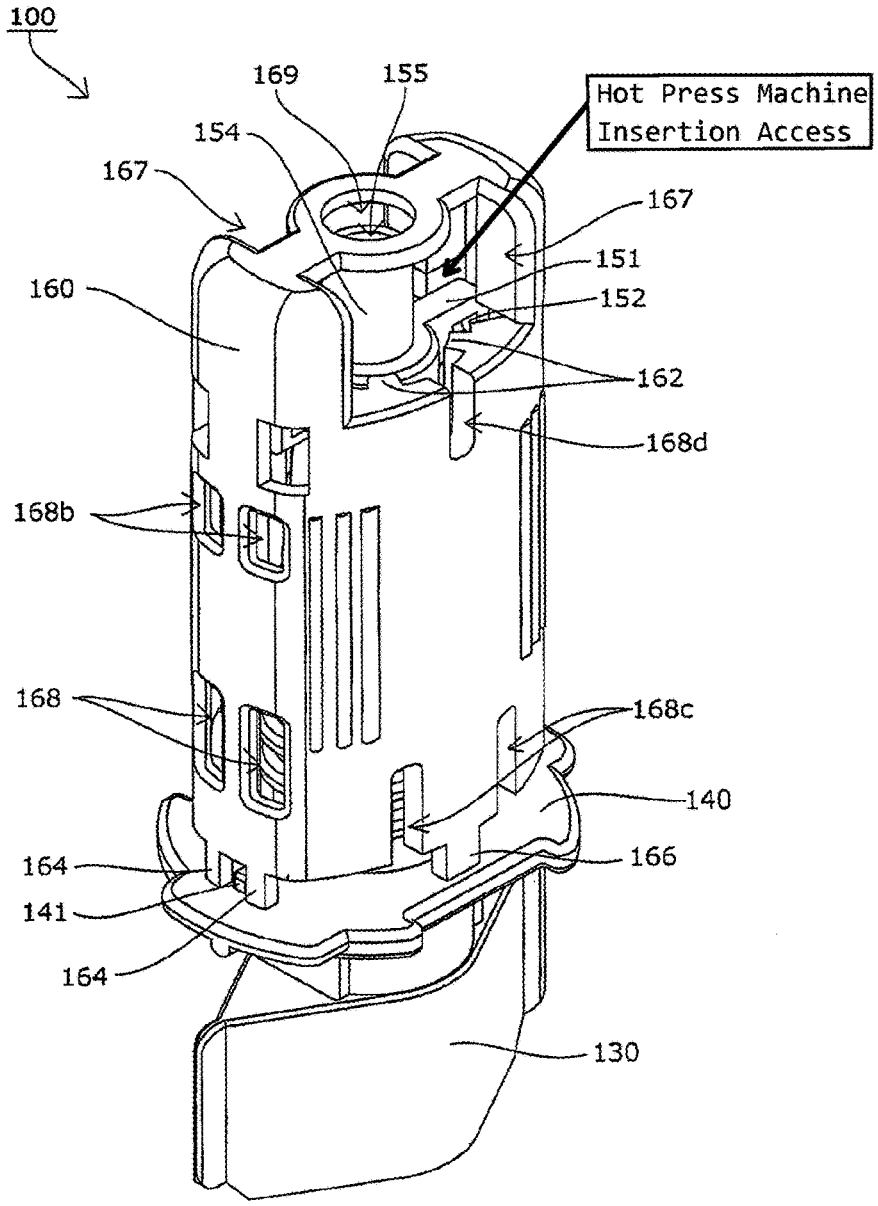
FIG. 4 is a perspective view illustrating the assembled breakable spout according to the embodiment of the present invention.
Figure 5:
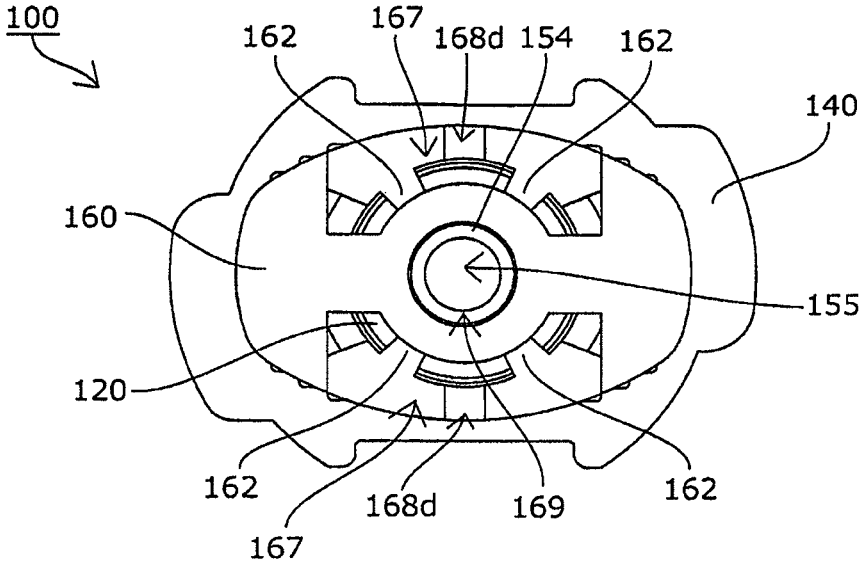
FIG. 5 is a plan view illustrating the assembled breakable spout according to the embodiment of the present invention.
Figure 9:
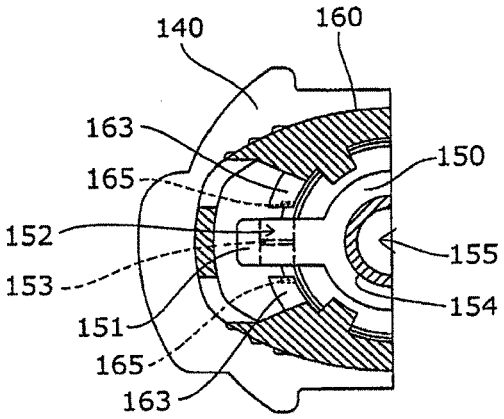
FIG. 9 is a sectional view taken along line A-A in FIG. 6.
Figure 10:
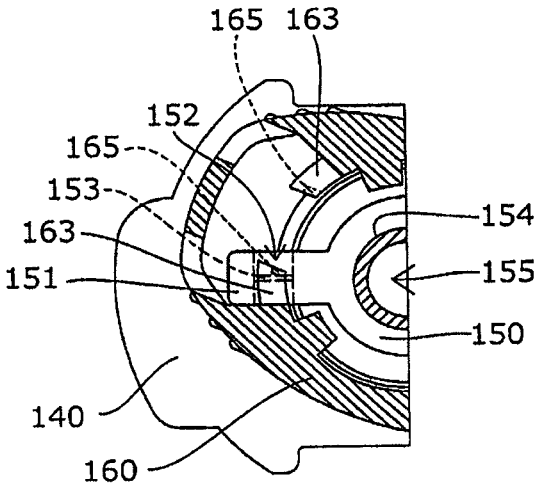
FIG. 10 is a sectional view of the cover illustrated in FIG. 9 when the cover is twisted.

Insertion arms 163 are each configured to face each of both ends of engaging hole 152 of operation arm 151 when cover 160 is fitted to the tip end side of spout body 110 to cover spout body 110, as illustrated in FIGS. 3, 9, and 10. Each insertion arm 163 extends along a circumference that is concentric with cylindrical part 120, to which cover 160 has been fitted. Accordingly, insertion arms 163 are inserted into engaging holes 152 when cover 160 is rotated about cylindrical part 120.

Insertion arm 163 that is first inserted into engaging hole 152 has protrusion 165 that protrudes downward at the tip end thereof. When cover 160 is rotated about cylindrical part 120 so that insertion arm 163 is inserted into engaging hole 152, protrusion 165 rides over and engages locking protrusion 153.

Leg parts 164 of cover 160 are configured to engage (contact or approach) both sides of protrusion 141 on the top surface of flange part 140 with regard to the rotational direction when cover 160 is fitted to the tip end side of spout body 110 and covers spout body 110. In other words, leg part 164 is comprised of a pair of legs.

In the embodiment, when cover 160 is fitted to the tip end side of spout body 110 and covers spout body 110, the lower ends of leg parts 164 are configured to contact the top surface of flange part 140. Protrusions 141 on flange part 140 are arranged at two opposing positions, 180 degrees spaced apart from each other, on a circumference that is concentric with cylindrical part 120. Leg parts 164 of cover 160 are disposed at positions that correspond to respective protrusions 141.

Other leg parts 166 are further provided at the lower end of cover 160 at positions 90 degrees spaced apart from leg parts 164 in the circumferential direction. When cover 160 is fitted to the tip end side of spout body 110 and covers spout body 110, the lower end surfaces of leg parts 166 contact the top surface of flange part 140.

Next, the operations and the effects of aforementioned breakable spout 100 according to the embodiment will be described.

In order to manufacture breakable spout 100, spout body 110 and cover 160 are first formed individually and prepared by resin injection molding. Then, cover 160 is placed over spout body 110 from the tip end side. Protrusions 161 on the inner circumferential surface of cover 160 then engage protrusions 123 on the outer circumferential surface of cylindrical part 120. Accordingly, cover 160 is fitted to the tip end side of spout body 110 to cover spout body 110. Breakable spout 100 is assembled in this manner.

When assembled, communication hole 155 at the tip end of spout body 110 (annular part 154) is in communication with flow channel 111 in spout body 110 and is not closed due to opening 169 at the top of cover 160. Therefore, flow channel 111 can be easily washed while cover 160 remains fitted. Flow channel 111 and the inside of the pouch may be simultaneously washed after spout 100 has been bonded to the pouch (bag-shaped package). The pouch may be charged with content from opening 169 at the top of the cover through communication hole 155.

After flow channel 111 of spout body 110 has been washed or after flow channel 111 has been washed and the pouch has been charged with the content via communication hole 155, deforming means for deforming annular part 154 of spout body 110 (not illustrated) is inserted through insertion window 167 of cover 160 in order to close communication hole 155. A specific example of the deforming means is a hot press machine that deforms resin annular part 154 with heat.

The deforming means may be inserted at the same time as predetermined portions of the pouch are bonded together. This simplifies the processes of manufacturing a pouch.

More specifically, a pouch may be manufactured by forming a sheet material into a bag shape and by sealing edges of the sheet material that has been formed. In this manufacturing processes, fitting part 130 of spout body 110 may be bonded with the sheet material that forms the pouch along a part of portions that are bonded before flow channel 111 of spout body 110 is washed, and the former may be bonded with the latter along the remaining portions after the inside of flow channel 111 is washed. In this case, the remaining portions may be bonded at the same time as the deforming means is inserted through insertion window 167 in order to cause deformation of annular part 154 and to close communication hole 155. Manufacturing steps can be thus reduced.

The pouch is charged with content after communication hole 155 has been closed and then the outer circumferential surface of spout body 110 and the inner circumferential surface of cover 160 are washed.

At this time, since cover 160 includes insertion windows 167, opening 169 and detergent circulation ports 168, 168*b*, 168*c*, 168*d*, a sufficient quantity of detergent flows between spout body 10 and cover 160 through insertion windows 167. As a result, the outer circumferential surface of spout body 110 and the inner circumferential surface of cover 160 can be effectively washed.

The inner circumferential surface of cover 160 is shaped so that it does not come into contact with breakable part 150 when cover 160 is fitted to the tip end side of spout body 110 to cover spout body 110. Therefore, the inner circumferential surface of cover 160 will never come into contact with breakable part 150 when cover 160 is being attached to spout body 110. As a result, no force is applied to breakable part 150 or weakened part 121 and damage to weakened part 121 is prevented.

When cover 160 is fitted to the tip end side of spout body 110 to cover spout body 110, ribs 162 come into contact with or close to the outer circumferential surface of cylindrical part 120 above protrusions 123 (refer to FIG. 8), and leg parts 164 and 166 come into contact with the top surface of flange part 140. Thus, even when an unintended external force is applied to cover 160, cover 160 does not move or moves only slightly, relative to spout body 110.

Further, a pair of legs that forms leg part 164 engages protrusion 141, provided on the top surface of flange part 140, on both sides of protrusion 141 with regard to the rotational direction of the cover. Accordingly, when an external force is applied to cover 160 in a twisting direction, cover 160 does not move, or only twists slightly, relative to spout body 110.

Therefore, when an external force is applied during transportation or storage of breakable spout 110 alone or of a pouch combined with breakable spout 110, breakable part 150 and weakened part 121 do not come into contst with cover 160. Thus, damage to weakened part 121 is prevented. In particular, after a pouch having breakable spout 110 is charged with the content and sealed, an external force does not cause any loss of sealing performance.

On the other hand, when breakable spout 100 that is comprised of cover 160 and spout body 110 is used, cover 160 is twisted by a force that exceeds the engaging force that is generated between leg part 164 and protrusion 141. Thereby, operation arms 151 of breakable part 150 are also twisted and weakened part 121 is broken.

Due to the twisting operation, protrusions 161 on the inner circumferential surface of cover 160 move relative to protrusions 123 on the outer circumferential surface of cylindrical part 120 along a circumference that is concentric with cylindrical part 120 and the engagement between the protrusions is released. As a result, the state in which cover 160 is fitted to spout body 110 is released, and cover 160 can be easily removed from spout body 110.

Further, insertion arms 163 of cover 160 are inserted into engaging holes 152 of operation arms 151 by twisting the cover so that protrusions 165 ride over and engage locking protrusions 153, as illustrated in FIG. 10. Accordingly, broken breakable part 150 can be removed integrally with cover 160 simply by removing cover 160. Since breakable part 150 is held by and is not separated from cover 160, cover 160 which is no longer necessary and breakable part 150 can be easily disposed of.

In the embodiment, insertion arms 163 are provided on both sides of engaging hole 152. Thus, breakable part 150 can be removed without being separated from cover 160 regardless of the direction in which cover 160 is twisted, either clockwise or anti-clockwise.

During a series of operations of breaking breakable part 150 and removing broken breakable part 150 and cover 160, cylindrical part 120 having flow channel 111 with an open tip end can be exposed without the user's finger touching cylindrical part 120 of spout body 110. Thus, a spout that can be handled hygienically can be supplied to the market.

Next, other embodiments will be described.

The breakable spout according to the present invention is suitably used as a spout for a pouch. However, in addition to being used for a pouch, the breakable spout may also be used for a bag-shaped package. As well as being used for a pouch, such a bag-shaped package may also be configured in the same manner as that of the present invention.

In the embodiment described above, protrusions 161 and ribs 162 are provided at four positions on the inner surface of cover 160 so that they are formed continuously in the vertical direction at the same circumferential positions on the inner surface of cover 160. However, the positions are not limited to four and may be three or less, or five or more. Moreover, a different numbers of protrusions 161 and ribs 162 may be arranged at different circumferential positions on the inner surface of cover 160.

Opening 169 that is formed on the top of cover 160 may be used as an insertion window, through which the deforming means for closing communication hole 155 (not illustrated) is inserted. Any shape and any area may be employed for opening 169, insertion windows 167 and detergent circulation ports 168, 168*b*, 168*c*, 169*d*.

Further, in the embodiment described above, ribs 162 function as contacting protrusion parts that contact or approach the outer circumferential surface of cylindrical part 120 above protrusions 123. However, a protrusion that has other shapes may also be used. Alternatively, the inner circumferential surface of cover 160 may be shaped to have a portion that is functionally similar to the rib. However, the contacting protrusion part can be formed with minimum protrusions and the shape of the cover can be simplified by using the rib shape, and manufacturing/assembling processes are thereby facilitated. When the possibility of failure of the breakable spout is low during storage and transportation processes once assembly has been completed and until the breakable spout is used, the contacting protrusion part may be omitted.

The shapes and numbers of protrusions 141 and leg parts 164, both of which prevent the rotation of cover 160, and legs 166, which stably support cover 160 that is placed over spout body 110, are not limited to the embodiment. Some or all of these elements may be omitted.

The breakable spout according to the present invention has been described by way of some embodiments. Needless to say, however, the present invention is not limited to the embodiments and the present invention may be carried out with various changes that may be made without departing from the technical teachings of the invention. Further, various configurations may be employed for a bag-shaped package having the breakable spout and for the method of manufacturing the same.

This application claims priority from Japanese Patent Application No. 2012-247320 filed on Nov. 9, 2012, which is hereby incorporated by reference herein in its entirety.

What is claimed is:

1. A breakable spout, comprising a spout body and a cover that covers an outer circumference of the spout body, the spout body and the cover being individually manufactured and assembled into the breakable spout, wherein the spout body comprises a cylindrical part and a breakable part, the cylindrical part has a center hole that serves as a flow channel, the breakable part is integrally formed at a tip end of the cylindrical part and is breakable at the tip end, wherein the spout body comprises an annular part which is deformable and is formed such that a side wall of the annular part protrudes from the breakable part toward a side opposite to the cylindrical part;

the annular part comprises a communication hole that communicates with the flow channel through the breakable part and that is deformed in order to be closed;

the cover is configured to cover the spout body, including the annular part, from a tip end side of the cylindrical part;

the cylindrical part has a first protrusion on an outer circumferential surface thereof;

the cover has a second protrusion on an inner circumferential surface thereof, wherein the second protrusion engages the first protrusion when the cover is fitted to the spout body such that the spout body, including the annular part, is covered with the cover from the tip end side of the cylindrical part;

the cover covers the spout body and is secured when the first protrusion engages the second protrusion; and the cover has an opening at a portion that faces the communication hole of the annular part when the cover is fitted to the spout body and covers the spout body, wherein the cover comprises a window configured to allow a hot press machine to access to the annular part in order to deform the annular part and closes the communication hole when the cover is fitted to the spout body and covers the spout body.

2. The breakable spout according to claim 1, wherein the window is open at a portion of the cover that corresponds to a side surface of the annular part when the cover covers the spout body.

3. The breakable spout according to claim 1, wherein the cover comprises a plurality of circulation ports that allow detergent to pass through.

4. A breakable spout comprising a spout body and a cover that covers an outer circumference of the spout body, the spout body and the cover being individually manufactured and assembled into the breakable spout, wherein the spout body comprises a cylindrical part and a breakable part, the cylindrical part has a center hole that serves as a flow channel, the breakable part is integrally formed at a tip end of the cylindrical part and is breakable at the tip end, wherein the spout body comprises an annular part which is deformable and is formed such that a side wall of the annular part protrudes from the breakable part toward a side opposite to the cylindrical part;

the annular part comprises a communication hole that communicates with the flow channel through the breakable part and that is deformed in order to be closed;

the cover is configured to cover the spout body, including the annular part, from a tip end side of the cylindrical part;

the cylindrical part has a first protrusion on an outer circumferential surface thereof;

the cover has a second protrusion on an inner circumferential surface thereof, wherein the second protrusion engages the first protrusion when the cover is fitted to the spout body such that the spout body, including the annular part, is covered with the cover from the tip end side of the cylindrical part;

the cover covers the spout body and is secured when the first protrusion engages the second protrusion; and the cover has an opening at a portion that faces the communication hole of the annular part when the cover is fitted to the spout body and covers the spout body, wherein:

the breakable part comprises a pair of operation arms that extends in a direction that crosses the flow channel;

the operation arm comprises an engaging hole that is open in a direction along a circumference that is concentric with the flow channel; and the cover has an insertion arm on an inner circumferential surface thereof, the insertion arm is inserted into the engaging hole when the cover is rotated about the flow channel.

5. The breakable spout according to claim 4, wherein:

the engaging hole has a locking protrusion at an inner surface thereof; and the insertion arm has a protrusion at a tip end thereof, the protrusion of the insertion arm rides over and engages the locking protrusion when the insertion arm is inserted into the engaging hole.

6. The breakable spout according to claim 4, wherein each of the insertion arms faces each of both ends of the engaging hole of the operation arm when the cover is fitted to the spout body and covers the spout body.

7. The breakable spout according to claim 1, wherein the cover has a contacting protrusion part on an inner circumferential surface thereof, wherein the contacting protrusion part contacts or approaches the outer circumferential surface of the cylindrical part at a position that is nearer to the tip end of the cylindrical part than the first protrusion when the cover is fitted to the spout body and covers the spout body.

8. The breakable spout according to claim 7, wherein the contacting protrusion part is comprised of a plurality of ribs that extend along the flow channel.

9. The breakable spout according to claim 1, wherein:

the spout body further comprises a fitting part and a flange part, wherein the fitting part is disposed at a rear end of the cylindrical part and can be fitted to a mouth of a bag-shaped package, and the flange part is disposed near the fitting part on the outer circumferential surface of the cylindrical part;

the cover has a plurality of legs at an end surface thereof, the end surface facing the flange part when the cover is fitted to the spout body and covers the spout body; and the flange part has protrusions on a surface thereof that corresponds to the end surface of the cover, wherein the protrusions engage the legs in order to prevent the cover from being rotated.

10. A bag-shaped package having a spout comprising:
the bag-shaped package for housing content; and
the breakable spout according to claim 1 that serves as the spout of the bag-shaped package.

* * * * *